US008640899B2

(12) United States Patent
Palusci

(10) Patent No.: US 8,640,899 B2
(45) Date of Patent: Feb. 4, 2014

(54) VIAL FOR RECEIVING A PREDEFINED DOSE OF A LIQUID

(75) Inventor: Victor Palusci, Saint Bonnet de Rochefort (FR)

(73) Assignee: Eskiss Packaging, Saint Bonnet de Rochefort (FR)

( * ) Notice: Subject to any disclaimer, the term of this patent is extended or adjusted under 35 U.S.C. 154(b) by 528 days.

(21) Appl. No.: 12/518,990

(22) PCT Filed: Dec. 10, 2007

(86) PCT No.: PCT/FR2007/052465

§ 371 (c)(1),
(2), (4) Date: Aug. 3, 2009

(87) PCT Pub. No.: WO2008/078031

PCT Pub. Date: Jul. 3, 2008

(65) Prior Publication Data

US 2010/0016824 A1 Jan. 21, 2010

(30) Foreign Application Priority Data

Dec. 13, 2006 (FR) ..... 06 55463

(51) Int. Cl.
*B65D 39/00* (2006.01)

(52) U.S. Cl.
USPC ..... 215/355; 215/253

(58) Field of Classification Search
USPC ..... 215/355, 364, 253; 220/23.38, 529; 206/570; 53/489
See application file for complete search history.

(56) References Cited

U.S. PATENT DOCUMENTS

| | | | | | |
|---|---|---|---|---|---|
| 733,701 | A | * | 7/1903 | Dalton | 222/520 |
| 1,966,611 | A | * | 7/1934 | Cobel | 222/189.07 |
| 2,028,175 | A | | 1/1936 | Waite | |
| 2,603,218 | A | * | 7/1952 | Rane | 215/247 |
| 2,775,369 | A | * | 12/1956 | Waite | 222/92 |
| 2,790,582 | A | * | 4/1957 | Halpern | 222/481.5 |
| 2,808,926 | A | * | 10/1957 | Drake et al. | 206/530 |
| 2,834,520 | A | * | 5/1958 | Nyden | 222/525 |
| 3,223,117 | A | * | 12/1965 | Curie et al. | 137/556.6 |
| 3,358,869 | A | * | 12/1967 | Palmer et al. | 220/233 |
| 3,737,973 | A | * | 6/1973 | Stawski | 29/407.1 |
| 3,776,433 | A | * | 12/1973 | De Treitas | 222/519 |
| 3,777,949 | A | * | 12/1973 | Chiquiari-Arias | 222/541.8 |
| 3,976,068 | A | * | 8/1976 | Lundquist | 604/518 |
| 3,991,758 | A | * | 11/1976 | Mohrke et al. | 604/403 |
| 4,019,663 | A | * | 4/1977 | Krautkramer | 222/529 |
| 4,041,945 | A | * | 8/1977 | Guiney | 604/91 |

(Continued)

FOREIGN PATENT DOCUMENTS

| | | | |
|---|---|---|---|
| WO | 98/03426 | A | 1/1998 |
| WO | 00/76875 | A | 12/2000 |

OTHER PUBLICATIONS

International Search Report for PCT/FR2007/052465, dated Jul. 14, 2008.

*Primary Examiner* — Anthony Stashick
*Assistant Examiner* — Christopher McKinley
(74) *Attorney, Agent, or Firm* — Heslin Rothenberg Farley & Mesiti P.C.

(57) ABSTRACT

A vial is closed by a stopper. The stopper is provided with arrangements allowing, in a first position, the filling of the vial with a liquid through an opening and, in a second position, the sealed and definitive closure of said opening.

7 Claims, 5 Drawing Sheets

(56) References Cited

U.S. PATENT DOCUMENTS

| | | | | | |
|---|---|---|---|---|---|
| 4,065,018 | A | * | 12/1977 | Megowen et al. | 215/231 |
| 4,134,511 | A | * | 1/1979 | Deussen | 215/48 |
| 4,227,617 | A | * | 10/1980 | Albrecht et al. | 215/251 |
| 4,248,227 | A | * | 2/1981 | Thomas | 604/200 |
| 4,351,455 | A | * | 9/1982 | Bond | 222/153.14 |
| 4,358,028 | A | * | 11/1982 | Chiquiar-Arias | 222/107 |
| 4,384,653 | A | * | 5/1983 | Connor et al. | 215/253 |
| 4,385,707 | A | * | 5/1983 | Leiter | 215/253 |
| 4,408,700 | A | * | 10/1983 | Fillmore et al. | 222/153.06 |
| 4,522,308 | A | * | 6/1985 | Sullivan | 215/253 |
| 4,598,839 | A | * | 7/1986 | Dombroski et al. | 222/92 |
| 4,688,703 | A | * | 8/1987 | Bayer | 222/541.8 |
| 4,883,641 | A | * | 11/1989 | Wicks et al. | 422/50 |
| 5,022,562 | A | * | 6/1991 | Lurkis et al. | 222/182 |
| 5,035,689 | A | * | 7/1991 | Schroeder | 604/234 |
| 5,085,332 | A | * | 2/1992 | Gettig et al. | 215/249 |
| 5,145,094 | A | * | 9/1992 | Perlmutter | 222/153.14 |
| 5,197,634 | A | * | 3/1993 | Beck | 222/109 |
| 5,202,093 | A | * | 4/1993 | Cloyd | 422/547 |
| 5,325,977 | A | * | 7/1994 | Haynes et al. | 215/307 |
| 5,325,980 | A | * | 7/1994 | Grimm et al. | 220/212 |
| 5,377,854 | A | * | 1/1995 | Cusack | 215/364 |
| 5,409,125 | A | * | 4/1995 | Kimber et al. | 215/48 |
| 5,433,330 | A | * | 7/1995 | Yatsko et al. | 215/247 |
| 5,519,984 | A | * | 5/1996 | Beussink et al. | 53/489 |
| 5,586,672 | A | * | 12/1996 | Schneider et al. | 215/250 |
| 5,598,939 | A | * | 2/1997 | Watson et al. | 215/307 |
| 5,651,471 | A | * | 7/1997 | Green | 220/231 |
| 5,669,427 | A | * | 9/1997 | Hasper et al. | 141/364 |
| 5,711,446 | A | * | 1/1998 | Jeffs et al. | 220/23.83 |
| 6,161,716 | A | * | 12/2000 | Oberhofer et al. | 220/203.04 |
| 6,241,124 | B1 | * | 6/2001 | Hoyt | 222/143 |
| D458,676 | S | * | 6/2002 | Berglund et al. | D24/115 |
| 6,792,743 | B2 | * | 9/2004 | Odell et al. | 53/452 |
| 6,918,418 | B1 | * | 7/2005 | Farris | 141/319 |
| 6,932,248 | B2 | * | 8/2005 | Fracasso | 222/522 |
| 7,753,234 | B1 | * | 7/2010 | Heiberger | 222/153.09 |
| 7,790,115 | B2 | * | 9/2010 | Sogaro | 422/400 |
| 2004/0045969 | A1 | * | 3/2004 | Chiang | 220/521 |
| 2004/0221905 | A1 | * | 11/2004 | Luo et al. | 138/89 |
| 2006/0131255 | A1 | * | 6/2006 | Blondeel | 215/229 |
| 2010/0125097 | A1 | * | 5/2010 | Soll et al. | 514/407 |

* cited by examiner

VIAL FOR RECEIVING A PREDEFINED DOSE OF A LIQUID

CROSS REFERENCE TO RELATED APPLICATIONS

This application is a national stage filing under section 371 of International Application No. PCT/FR2007/052465 filed on Dec. 10, 2007, and published in French on Jul. 3, 2008 as WO 2008/078031 and claims priority of French application No. 0655463 filed on Dec. 13, 2006, the entire disclosure of these applications being hereby incorporated herein by reference.

BACKGROUND ART

The invention relates to the technical field of receptacles for receiving a predefined dose of a liquid.

This type of receptacle can be used in the field of pharmaceuticals, food supplements and cosmetology.

In general, this type of receptacle is in the form of a glass ampoule of which one end is broken in order to collect the liquid. For example, the ampoule has a generally cylindrical shape with two tapered ends. In this case, it is necessary to break both ends to collect the liquid. One of these ends enables the liquid to flow while the other end enables air to enter so as to permit the flow.

Ampoules are also known in the form of fine tipped bottles, which must also be broken to collect the liquid.

This type of receptacle incurs difficulties and risks of injury at the time of the filling of the ampoule and at the time of its use.

For wide neck ampoules, filling is generally carried out with a needle, which is unsuitable for high filling rates, while for fine tipped ampoules, filling generally takes place by vacuum.

The invention relates more particularly to this vacuum filling technique.

In a manner perfectly known to a person skilled in the art, ampoules are packed and arranged in boxes known by the name of cristallisoir. These cristallisoirs, which are generally square, can accommodate 200 to 500 ampoules, according to their capacity. For the filling of the liquid, a machine is used having an open vacuum tank at the top and equipped with a pivoting lid. Combs are fastened to the lid in order to maintain the ampoules after having turned over the cristallisoir with all the ampoules that it contains. In other words, the opened tips of the ampoules, which were initially pointing upwards, point downwards after being overturned, and are immersed in the liquid. It then suffices to create a vacuum in the tank, in order to remove the air contained in the said ampoules. When the vacuum is removed, that is, when the air is allowed to return into the tank, the ampoules draw in the liquid.

At this stage of the filling, it is conceivable that some ends of the ampoules may be broken and fine glass particles may be present in the liquid. In other words, the risk of filling an ampoule with a liquid containing glass fragments cannot be discounted.

The cristallisoir is then turned over to send all the ampoules thus filled to a welding station, generally using a burner.

As stated above, other drawbacks and difficulties appear in the use of these ampoules. In fact, most of them are shaped so as to be self-breakable, which in itself raises a number of difficulties, since the self-breakable portion must be sufficiently fragile while being sufficiently solid for the ampoule in particular to withstand its transport, filling, packaging, etc. It is also observed that the fracture zone is not always visible to the user, so that the latter sometimes experiences problems in breaking the end or ends of the ampoule.

To attempt to remedy these drawbacks, receptacles with a predefined dose have been proposed. These receptacles are in the form of a glass or plastic vial, having a generally cylindrical shape, having one closed end constituting the bottom and one open end, for filling the bottle and removing the liquid. This opening is closed by a seal, generally made from aluminium and equipped with a tab for pulling it out in order to release the opening. However, it appears that the removal of the seal, including with the tab, is very difficult, or even impossible, to do since the seal is hot-sealed. For this reason, it has been proposed to provide this type of receptacle with a straw in order to perforate the seal and draw out the product, thereby considerably reducing the applications and increasing the costs.

It is an object of the invention to remedy these drawbacks, simply, safety, effectively and efficiently.

BRIEF SUMMARY OF INVENTION

The problem that the invention proposes to solve is to produce a vial for receiving a predefined dose of liquid, in particular in the field of pharmacy, cosmetology, food supplements, etc., with the aim, on the one hand, of easily and continuously filling the receptacle with predefined liquid, using a vacuum filling machine in particular, and, on the other hand, of easily opening the receptacle to collect the liquid, while complying with the sealed and tamper proof nature of the receptacle, before its use by the consumer.

To solve such a problem, a vial has been designed and developed for receiving a predefined dose of a liquid, the said vial being closed by a stopper. According to the invention, the stopper has arrangements suitable, in one position, for filling the vial with liquid via an opening, and then, in another position, for the sealed and definitive closure of the said opening.

In a first embodiment, to solve the problem of permitting, in a first step, the filling of the vial with liquid and then, in a second step, the sealed closure thereof, the arrangements consist of an orifice which has a centring seating for being press fit into an opening of the vial under a pressure force exerted on a closed tip which the said seating has, the said orifice being placed, in the filling position, in communication with the exterior and, after fitting under the pressure force, with the interior of the vial.

The press fit seating and the tip are connected by a sectile zone.

The sectile zone is formed from a support shoulder in the inserted position of the stopper corresponding to the shutting of the orifice.

For the use of vial, that is to drink the liquid directly or to pour it into another container, it suffices to hold the vial with one hand, and, for example using the thumb, to break off the sectile tip in order to obtain unrestricted access to the opening of the vial.

In another embodiment, the arrangements consist of a closed outer flap placed coaxially with an opening of the stopper and bounding an internal recess in communication with the said opening and with the exterior via at least one orifice, the said flap being joined to the stopper by a sectile zone under a pressure force corresponding to the sealed shutting of the said opening.

The flap body has a portion in relief, in the form of a pad, suitable for cooperating by bearing on the edge of the opening inside the stopper, to ensure the blocking of the said flap in the closed position in combination with an outer collar bearing on the edge of the opening, outside the said stopper. Advantageously, the collar is formed with the end of the recess of the flap.

In another embodiment, the stopper is removably fastened to one of the ends of the vial by a tamper proof system, the emptying of the said vial for the taking of the liquid, taking place after detachment of the said stopper from its tamper proof system. The tamper proof system is a removable strip placed at the base of the stopper and cooperating with the retaining arrangements of the vial. The stopper is fastened at the end of the vial by screwing or clipping.

In another embodiment, the stopper is permanently fastened to one of the ends of the vial whereof the other end is shaped in the form of a sectile tip for the taking of the liquid.

On the strength of this basic design, the vial may have a glass or plastic body.

BRIEF DESCRIPTION OF DRAWING FIGURES

The invention is described below in greater detail in conjunction with the figures in the appended drawings in which.

DETAILED DESCRIPTION

The vial (1) is in the form of a body, generally cylindrical, and suitable for being made from various materials, such as glass, plastic, polypropylene. The dimensions of the vial are variable, according to the volume of the product to be distributed, which generally corresponds to standards in force. In general, this vial accommodates a predefined dose of a liquid, usually for single use.

According to one basic feature of the invention, the vial (1) is closed by a stopper (2) which has arrangements suitable, in one position of the said arrangements, for filling the vial (1) with liquid and then, in another position of the said arrangements, for the sealed and definitive closure of the vial (1). More particularly, the filling and sealed closure take place via an opening (2*a*) of the stopper. In one embodiment, this opening (2*a*), of generally circular shape, is formed coaxially with the upper face (2*b*) of the said stopper.

For this purpose, the filling and sealed closure arrangements consist of an outer flap (2*c*) placed coaxially with the filling opening (2*a*) of the stopper. This flap (2*c*) bounds an inner recess (2*c*1) communicating with the opening (2*a*), that is communicating with the interior of the vial and also communicating with the exterior via at least one orifice (2*c*2).

The flap (2*c*) is joined to the body of the stopper (2) by a zone (2*d*) that is sectile under the effect of a pressure corresponding to the sealed closure of the said opening (2*a*). This sectile zone (2*d*) is placed peripherally with the opening (2*a*).

Figure 1:
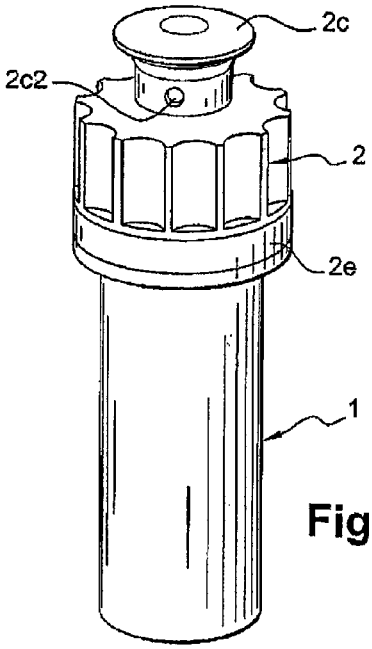
FIG. 1 is a perspective view of the vial according to a first embodiment, the stopper being shown in the vial filling position.
Figure 2:
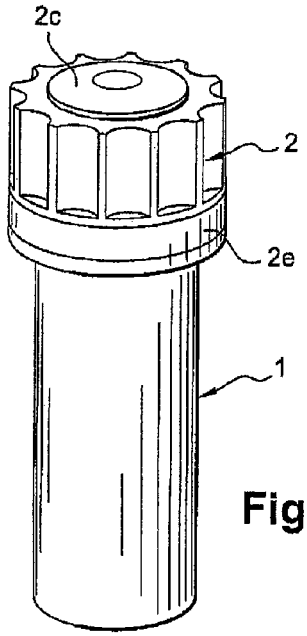
FIG. 2 is a similar view to FIG. 1 in the vial sealed closed position.
Figure 3:
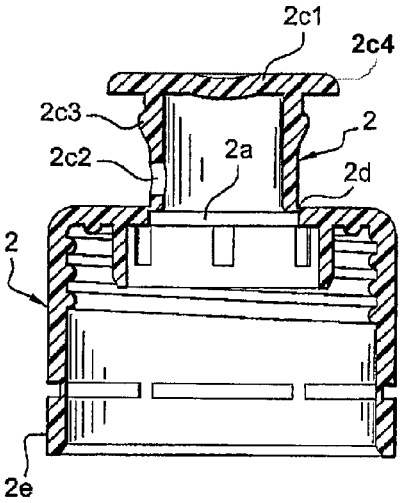
FIG. 3 shows a longitudinal section of the stopper corresponding to FIG. 1.
Figure 4:
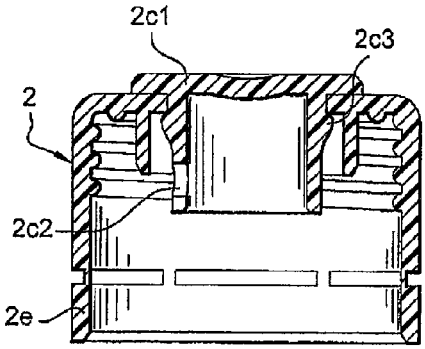
FIG. 4 shows a longitudinal section of the stopper corresponding to FIG. 2.
Figure 5:
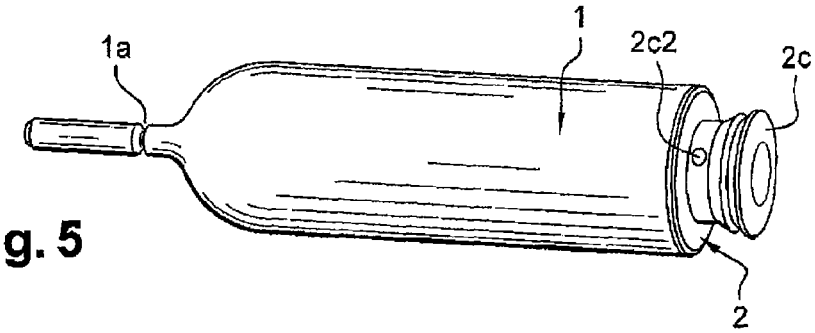
FIG. 5 is a perspective view of another embodiment of the vial, in the filling position.
Figure 6:
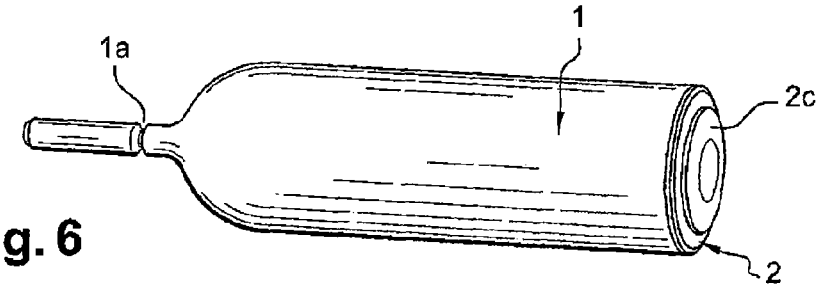
FIG. 6 is a similar view to FIG. 5 in the vial sealed closure position.
Figure 7:
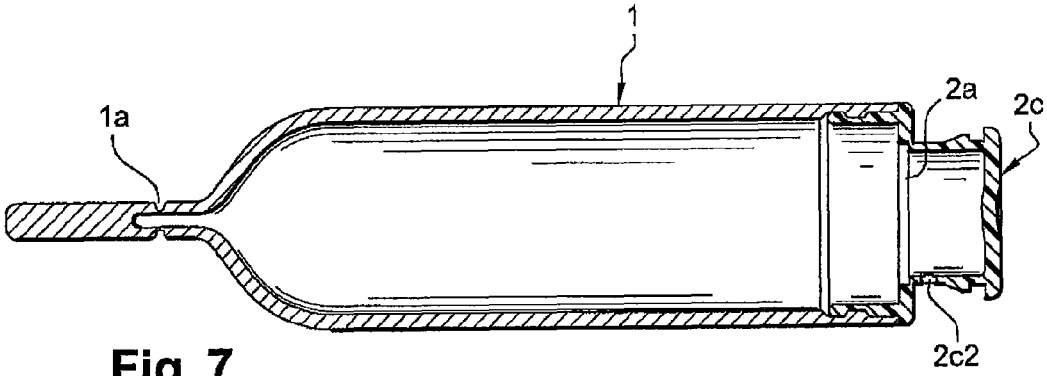
FIG. 7 shows a longitudinal section corresponding to FIG. 5.
Figure 8:
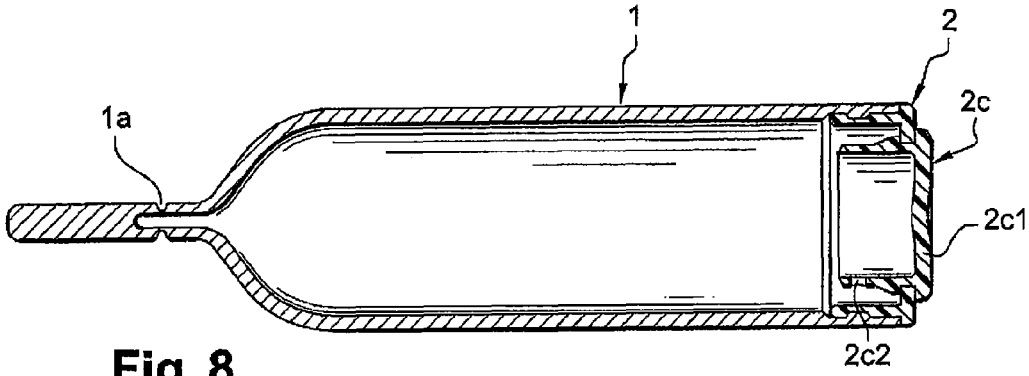
FIG. 8 shows a longitudinal section corresponding to FIG. 6.
Figure 9:
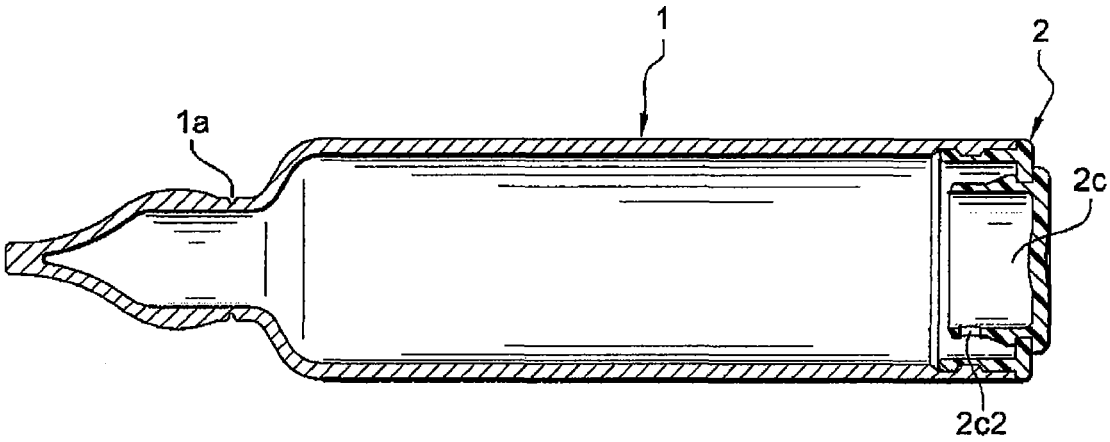
FIG. 9 shows another embodiment of the vial corresponding to FIGS. 5, 6, 7 and 8.

The body of the flap (2*c*) has a portion in relief in the form of a pad or boss (2*c*3) suitable for cooperating by bearing on the edge of the opening (2*a*), inside the stopper (2). This boss (2*c*3) holds the said flap in the shut position in combination with an outer collar (2*c*4) bearing on the edge of the opening (2*a*), outside the stopper (2). Reference can be made to FIG. 3 which shows the stopper in the flap outlet position corresponding to the filling and to FIG. 4 which shows the flap in the inserted position under a pressure force acting on the latter and corresponding to the sealed closure of the stopper.

The collar (2*c*4) is formed with the end of the recess of the flap (2*c*).

Based on this design, various embodiments can be considered. In FIGS. 1, 2, 3 and 4, the stopper (2) is fastened removably to one of the ends of the vial by a tamper proof system. In this case, for removing the liquid, the vial is emptied after detaching the stopper (2) from its tamper proof system.

In a manner perfectly known to a person skilled in the art, this tamper proof system may, for example, be provided by a detachable strip (2*e*) placed at the base of the stopper (2) and cooperating with vial retaining arrangements. The stopper (2) is fastened at the end of the vial (1) by screwing, clipping or other means.

In the embodiment shown in FIGS. 5 to 9, the stopper (2) is permanently fixed to one of the ends of the vial (1). In this case, the other end (1*a*) of the vial is provided in the form of a sectile tip for removing the liquid. In a manner known per se, this sectile tip (1*a*) may be shaped like the one shown in FIGS. 5 to 8 or the one shown in FIG. 9.

FIGS. 10 to 14 show an advantageous embodiment of the invention.

In this embodiment, the opening of the vial (1) directly receives the stopper (2) as shown by the abovementioned figures. The stopper (2) has a centring seating (2*f*) for being press fit into the vial (1) under a pressure force exerted on the said stopper. The seating (2*f*) is coaxially prolonged by a closed tip (2*g*). In this embodiment, the filling arrangements consist of an orifice (2*h*) which has the seating (2*f*).

The press fit seating (2*f*) and the tip (2*g*) are connected by a sectile zone (2*i*). This sectile zone (2*i*) is formed from a support shoulder (2*j*) in the inserted position of the stopper, corresponding, as stated below, to the closing of the orifice (2*h*). It should be observed that the seating (2*f*), under the shoulder (2*g*), has a reduced taper to ensure the press fitting of the stopper (2) into the vial (1).

Figure 11:
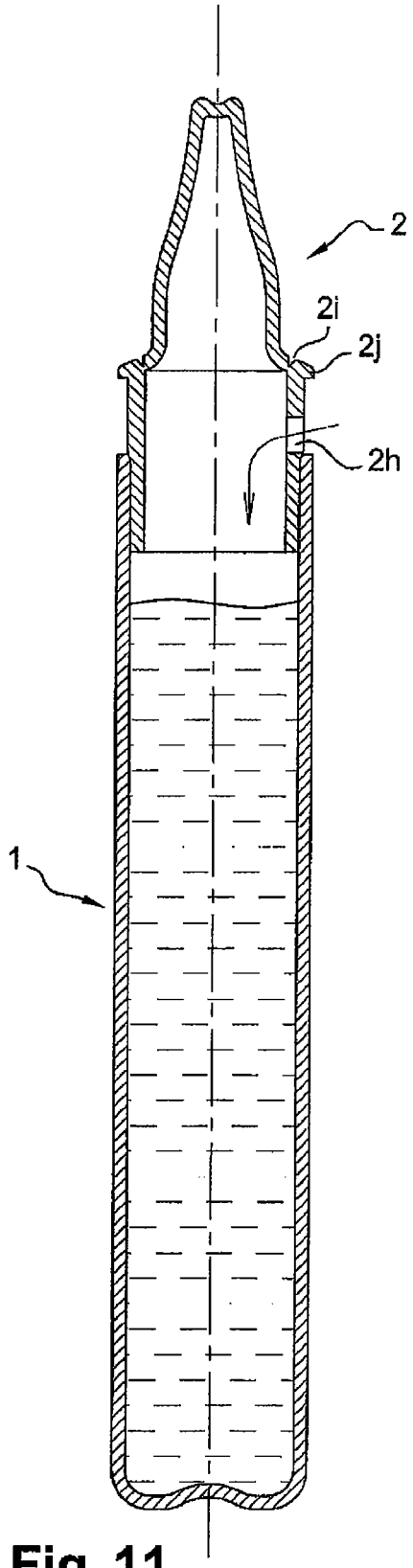
FIG. 11 shows a section according to the embodiment shown in FIG. 10, the vial being shown in the filling position, that is before complete insertion of the stopper.

For the filling, the stopper is not completely inserted into the vial, so that the orifice (2*h*) communicates with the exterior. It should be noted that in this filling position, the stopper is inserted to substantially the conical press fit seating. Similarly, in this filling position, the stopper (2) is perfectly secured at the open end of the vial because the press fit diameter is larger than the inside diameter of the vial. Filling as such can take place by the vacuum technique, as stated in the introduction of the specification. This filling position is shown in FIG. 11.

After filling, it suffices to apply a pressure to the tip (2*g*) until the shoulder (2*j*) bears against the end of the vial to ensure that it is closed in a perfectly sealed manner. In this closure position, FIG. 12, the orifice (2*h*) no longer communicates with the exterior, but is positioned inside the vial (1).

Figure 13:
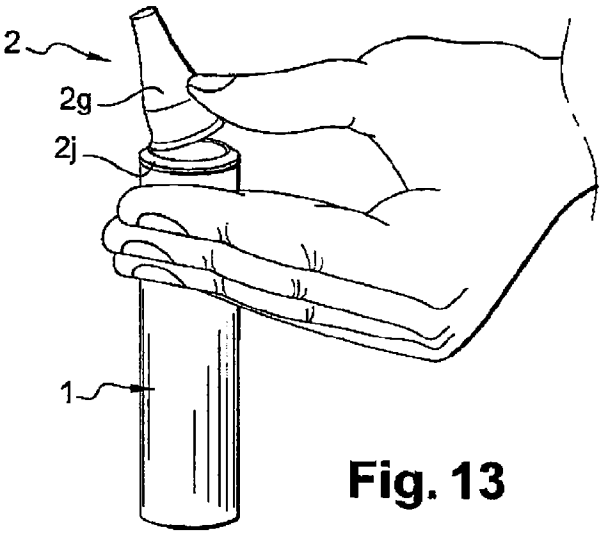
FIGS. 13 and 14 are perspective views showing the use of the vial shown in FIGS. 10, 11 and 12.
Figure 14:
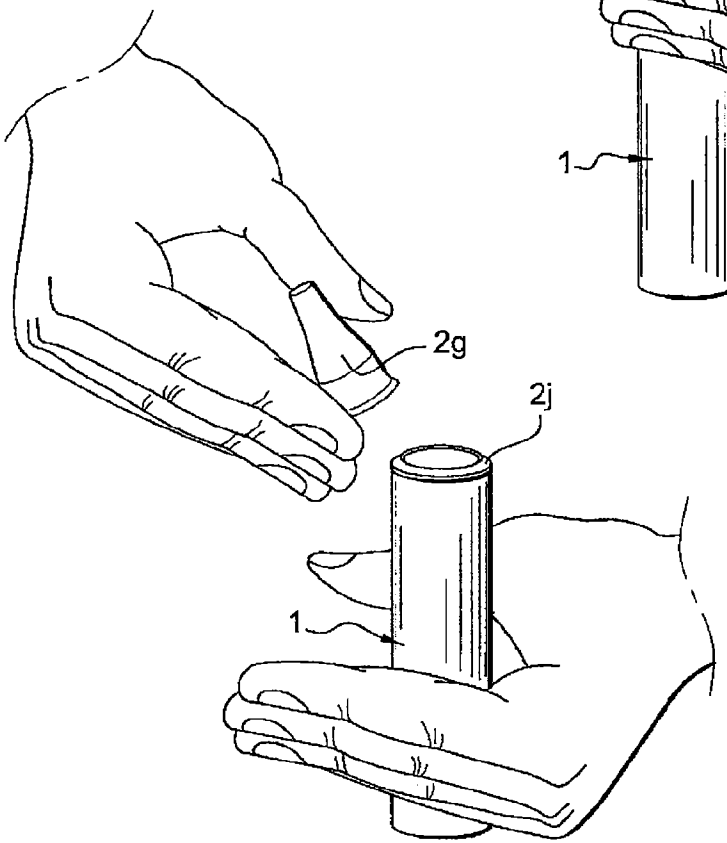
Figure 10:
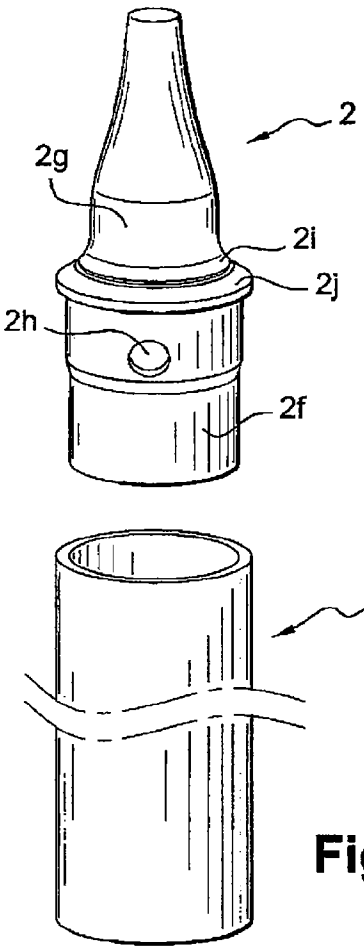
FIG. 10 is a perspective view of the preferred embodiment of the vial according to the invention, before the insertion of the stopper.

To remove the liquid contained inside the vial and as shown in FIGS. 13 and 14, it suffices to hold the vial with one hand, and using the thumb for example, to break off the tip (2*g*) (FIG. 14).

As indicated, regardless of the embodiment, it is always possible to fill a very large number of vials by placing the said vials in an orderly way in a cristallisoir which is subjected to the action of a vacuum filling machine, as indicated in the introduction to the specification. However, advantageously, it is observed that since the vials do not have fragile zones at their ends, it is possible to use cristallisoirs with much larger capacities.

Figure 12:
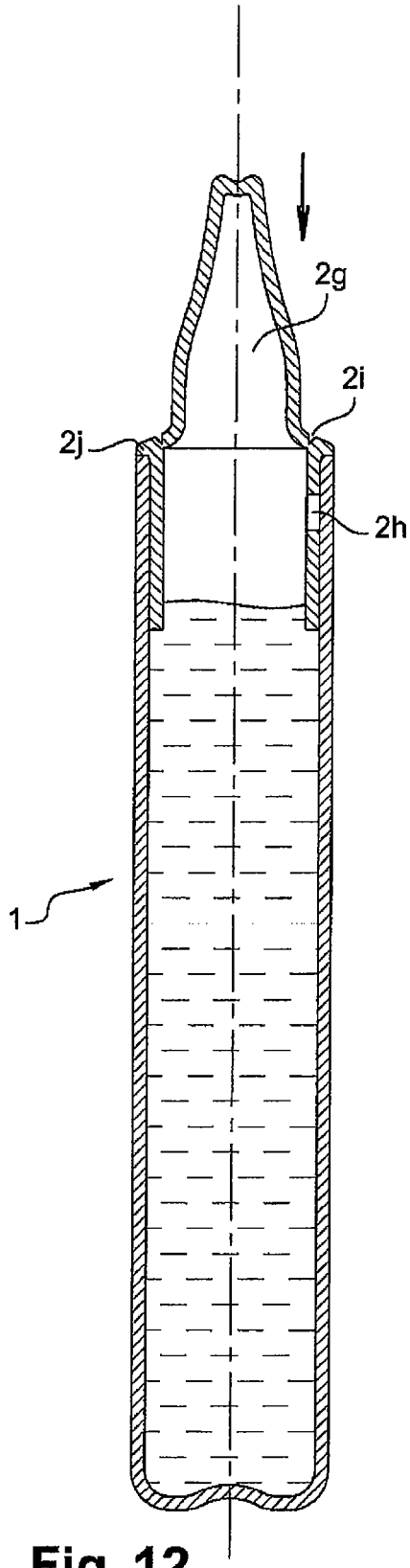
FIG. 12 is a view corresponding to FIG. 11, after filling the vial, that is, after inserting the stopper, sealing the vial.

It is also observed that the sealed closure of the various vials, after having filled them with the predefined dose of liquid, takes place very simply and effectively, because it suffices to apply a pressure to the flaps (FIG. 3) to completely seal the stopper (FIG. 4), or directly to the stopper (FIGS. 11 and 12).

The advantages clearly appear from the description. In particular, the following are emphasized and recalled:

the absence of any risk of glass fragments at the time of filling and use;

ease of use;

aesthetics.

The invention claimed is:

1. Vial for receiving a predefined dose of a liquid, the vial having an open end, and a multipositional stopper engaged with the open end, the stopper having an opening coaxial with the open end of the vial and facing an interior of the vial, a closed tip opposite the opening, a side wall extending between an edge of the opening and the closed tip, and an orifice in the side wall of the stopper, the orifice being in fluid communication with an exterior of the vial and serving as an entry for liquid flow from the exterior through the orifice and the opening into the interior of the vial for filling the vial with the liquid in a first position of the engaged stopper, and the orifice being interior of the vial with the liquid flow blocked in another position of the engaged stopper, wherein the side wall of the stopper comprises a centering seating dimensioned to press fit against a side wall of the vial at the open end of the vial under a pressure force exerted on the closed tip of the stopper, the orifice being situated in the seating, and wherein the seating and the tip are connected by a sectile zone located further from the edge of the opening than the orifice.

2. Vial according to claim 1, wherein the sectile zone is formed from a support shoulder of the stopper positioned outside of the vial in an inserted position of the stopper corresponding to shutting of the orifice.

3. Vial according to claim 1, wherein the vial has a glass body.

4. Vial according to claim 1, wherein the vial has a plastic body.

5. Vial according to claim 1, wherein a section of the side wall containing the orifice extends beyond the open end of the vial in the first position, and said portion is positioned within the open end of the vial in the another position.

6. Vial according to claim 1, wherein, in the first position, the side wall is not completely pressed down into the vial, and, in the another position, the side wall is completely pressed into the vial, and in both the first position and the another position, an exterior surface of the side wall of the stopper presses against an interior surface of the side wall of the vial.

7. Vial according to claim 1, wherein the first position facilitates the liquid flow and the filling of the vial with the liquid by a vacuum technique.

* * * * *